US009212865B2

(12) United States Patent
Dubreuil

(10) Patent No.: US 9,212,865 B2
(45) Date of Patent: Dec. 15, 2015

(54) HINGED HAND GUARD

(71) Applicant: Sig Sauer, Inc., Newington, NH (US)

(72) Inventor: Ronald Dubreuil, Epsom, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 14/571,830

(22) Filed: Dec. 16, 2014

(65) Prior Publication Data

US 2015/0168095 A1 Jun. 18, 2015

Related U.S. Application Data

(60) Provisional application No. 61/916,886, filed on Dec. 17, 2013.

(51) Int. Cl.
*F41C 23/16* (2006.01)

(52) U.S. Cl.
CPC ..... *F41C 23/16* (2013.01)

(58) Field of Classification Search
CPC ..... F41C 23/16
USPC ..... 42/71.01, 75.01, 75.02, 83, 90, 96
See application file for complete search history.

(56) References Cited

U.S. PATENT DOCUMENTS

| | | | | |
|---|---|---|---|---|
| 5,343,650 | A * | 9/1994 | Swan | 42/117 |
| 5,351,598 | A * | 10/1994 | Schuetz | 89/185 |
| 5,826,363 | A * | 10/1998 | Olson | 42/75.01 |
| 6,792,711 | B2 * | 9/2004 | Battaglia | 42/114 |
| 7,059,076 | B2 * | 6/2006 | Stoner et al. | 42/75.01 |
| 7,793,452 | B1 | 9/2010 | Samson et al. | |
| 8,141,289 | B2 | 3/2012 | Gomez et al. | |
| 8,191,300 | B2 | 6/2012 | Daniel | |
| 8,276,304 | B2 | 10/2012 | Samson et al. | |
| 8,448,367 | B2 | 5/2013 | Samson et al. | |
| 2011/0239513 | A1 | 10/2011 | Sandman | |

FOREIGN PATENT DOCUMENTS

| | | | |
|---|---|---|---|
| GB | 2455760 | B | 12/2009 |
| WO | 2007087866 | A1 | 8/2007 |

* cited by examiner

*Primary Examiner* — Bret Hayes
(74) *Attorney, Agent, or Firm* — Finch & Maloney PLLC

(57) ABSTRACT

A hand guard assembly for installation on a standard barrel nut is disclosed. In accordance with some embodiments, the hand guard assembly may include a hinged hand guard comprising a left clamshell component and a right clamshell component, which may be mounted on a standard barrel nut. The design of the hinged hand guard allows the hand guard to securely fasten on the standard barrel nut by accommodating the sprockets of the standard barrel nut in an internal radial groove, and/or encasing the firearm's gas tube in a longitudinal notch. The disclosed configurations may allow a user to attach and remove the hand guard easily and quickly from the firearm without modifying the standard barrel nut or removing the gas block.

20 Claims, 10 Drawing Sheets

HINGED HAND GUARD

CROSS-REFERENCE TO RELATED APPLICATIONS

This application claims the benefit of U.S. Provisional Patent Application Ser. No. 61/916,886, titled "HINGED HAND GUARD" filed Dec. 17, 2013, which is herein incorporated by reference in its entirety.

FIELD OF THE DISCLOSURE

The disclosure relates to firearms and more particularly to hand guards for use with firearms.

BACKGROUND

Hand guards have been developed for use with firearms, and may provide various functions when mounted on a firearm. For example, hand guards may protect a user from heat generated by the firearm barrel during use. Hand guards may also provide secure gripping means, and offer additional surfaces which may be used to mount accessories to a firearm.

SUMMARY

According to an example embodiment, a hand guard for a firearm includes a first clamshell component comprising a top longitudinal edge defining a receiving channel, a bottom longitudinal edge, an inner surface and an outer surface. The hand guard further includes a second clamshell component comprising a top longitudinal edge defining a monorail formed to mate with the receiving channel, a bottom longitudinal edge, an outer surface and an inner surface. The hand guard further includes a fastener for securing the bottom longitudinal edge of the first clamshell component to the bottom longitudinal edge of the second clamshell component. In some cases, the hand guard also includes a radial groove on the inner surfaces of both the first clamshell component and the second clamshell component. In some such cases, the radius of the radial groove is approximately equal to the radius of a barrel nut. In some cases, the inner surface of one of either the first clamshell component or the second clamshell component includes a longitudinal notch. In some cases, the first clamshell component is completely detachable from the second clamshell component. In some cases, the hand guard also includes a mounting rail. In some such cases, the mounting rail is formed on the outer surface of at least one of the first clamshell component or the second clamshell component. In some cases, the first clamshell component is formed to encase a left side of a firearm and the second clamshell component is formed to encase a right side of a firearm. In some cases, the hand guard does not include a hinge pin separate from the clamshell components. In some cases, the first clamshell component fits on a top side of a firearm and the second clamshell component fits on a bottom side of a firearm. In some cases, the hand guard is configured to be attached to an M16-style firearm. In other cases, the hand guard is configured to be attached to an AR15-style firearm. In some cases, at least one of the first clamshell component or the second clamshell component includes at least one aperture extending from the inner surface to the outer surface. In some cases, the first clamshell component and the second clamshell component are each semi-tubular, and the hand guard has a substantially circular cross-section. In some cases, the fastener is threaded. In some cases, the fastener includes a first element and a second element. In some such cases, the first element is both interlockable with the second element and detachable from the second element. In some such cases, the second element is integral to the bottom longitudinal edge of the second clamshell component. In some cases, the receiving channel extends from a front end of the first clamshell component to a back end of the first clamshell component and the monorail extends from a front end of the second clamshell component to a back end of the second clamshell component.

According to another example embodiment, a firearm assembly includes a firearm having a barrel, a gas tube and a barrel nut fastened to the barrel. The barrel nut has sprockets extending radially from the barrel nut. The firearm assembly further includes a hand guard attachable to the barrel and detachable from the barrel. The hand guard includes a first side having an inner surface defining a radial groove and an outer surface defining a recess, the recess extending longitudinally from a front portion of the hand guard to a rear portion of the hand guard. The hand guard also includes a second side including an inner surface defining a radial groove aligned with the radial groove of the first side and an outer surface defining an integral hinge pin. The hinge pin extends longitudinally from a front portion of the hand guard to a rear portion of the hand guard. The hinge pin is sized to fit inside the recess, such that the first side of the hand guard can be pivotally connected to the second side of the hand guard. The firearm assembly also includes a fastener configured to connect the first side of the hand guard and the second side of the hand guard. The fastener is able to lock the second side of the hand guard and the first side of the hand guard together such that the hand guard encircles the barrel when the hand guard is secured on the barrel nut, and wherein the only point of contact between the barrel and the hand guard is at the barrel nut. In some cases, the assembly also includes a mounting rail formed on the outer surface of at least one of the first side of the hand guard and the second side of the hand guard. In some cases, at least one of either the inner surface of the first side or the inner surface of the second side comprises a longitudinal notch formed to accommodate the gas tube.

According to another example embodiment, a firearm includes a barrel, a barrel nut and a hand guard. The barrel has a longitudinal axis, a right side and a left side. The barrel nut is aligned with the longitudinal axis of the barrel. The hand guard includes a first hand guard component and a second hand guard component. The second hand guard component is pivotally connected to the first hand guard component about an axis parallel to the longitudinal axis of the barrel, such that in a mounted state the second hand guard component is substantially disposed on the right side of the barrel. The first component and the second component, together, encircle at least a portion of the barrel, and an inner surface of the hand guard is in contact with the barrel nut when in a mounted state. In some cases, the first hand guard component includes a radial groove on an inner surface, and the radial groove is formed to accommodate the barrel nut. In some cases, the firearm further includes a gas tube. In some such cases, at least one of either the first hand guard component or the second hand guard component comprises a longitudinal notch located on an inner surface. In some such cases, the longitudinal notch is formed to accommodate the gas tube.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the inventive subject matter.

Figure 1A:
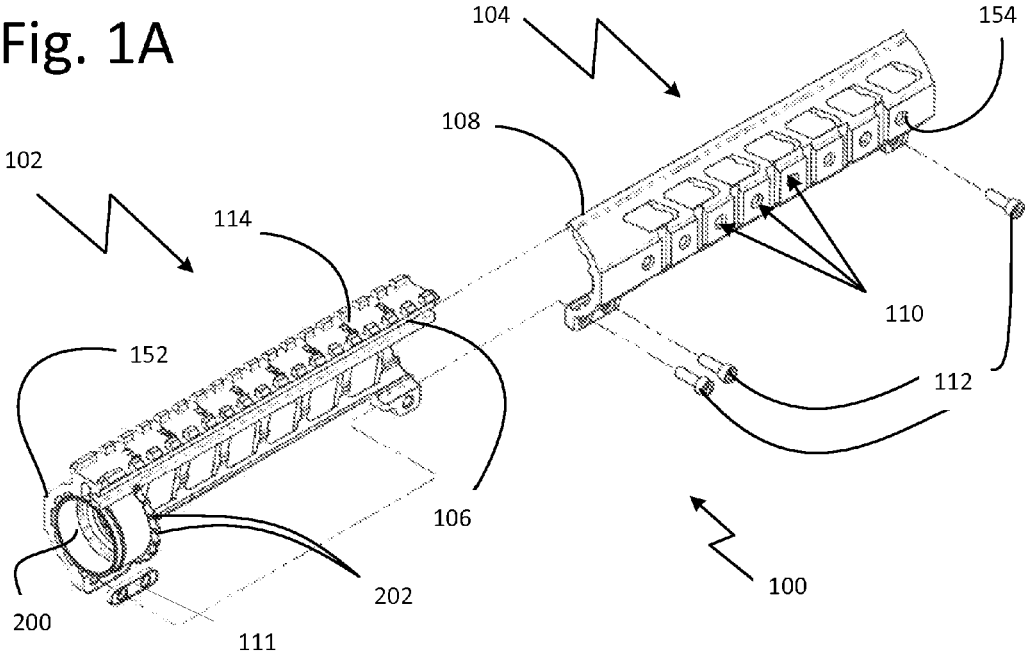
FIG. 1A is an exploded view of a hand guard assembly configured in accordance with an embodiment of a hand guard assembly.

These and other features of the present embodiments will be understood better by reading the following detailed description, taken together with the figures herein described. In the drawings, each identical or nearly identical component that is illustrated in various figures may be represented by a like numeral. For purposes of clarity, not every component may be labeled in every drawing. Furthermore, as will be appreciated, the figures are not necessarily drawn to scale or intended to limit the claimed invention to the specific configurations shown. In short, the figures are provided merely to show example structures.

DETAILED DESCRIPTION

Described herein are a variety of hand guard assemblies to be used over the barrel of a firearm. In one set of embodiments, a hand guard assembly is provided, the hand guard assembly being capable of mounting on a standard barrel nut without modifying the standard barrel nut, and the hand guard assembly capable of removal from the standard barrel nut without disassembly of the gas block. In accordance with some embodiments, the disclosed hand guard assembly includes a first clamshell component and a second clamshell component, wherein the first clamshell component and the second clamshell component are hingedly connected together and can pivot with respect to each other about the hinge. In some embodiments, the hand guard assembly may comprise two mating hinge members, wherein one hinge member is formed on the first clamshell component and the other hinge member is formed on the second clamshell component. In some of these embodiments, the hand guard assembly may comprise a monorail hinge formed on one of either the first clamshell component or the second clamshell component and a tubular receiving channel formed on the other of the two clamshell components, wherein the tubular receiving channel is configured to mate with the monorail hinge. The first clamshell component may pivot with respect to the second clamshell component, and/or the second clamshell component may pivot with respect to the first clamshell component. In some embodiments, the first clamshell component may be completely detachable from the second clamshell component and can be detached without removing a pin or any additional component. In other embodiments, the first clamshell component and the second clamshell component may be permanently joined. In some embodiments, the interior surface of the first clamshell component and/or the interior surface of the second clamshell component may comprise an internal radial groove, configured to accommodate sprockets of a barrel nut. In further embodiments, the first clamshell component or the second clamshell component may comprise a longitudinal notch on an inner wall, wherein the longitudinal notch is shaped to accommodate the gas tube of a firearm.

In one embodiment, the hand guard assembly may include a mounting rail. The mounting rail may provide a surface onto which accessories, such as scopes, laser aiming devices, tactical lights, night vision devices, foregrips, bipods, and/or bayonets may be mounted.

In some embodiments, the hand guard assembly may alternate between an open position and a closed position, and in so doing, may experience a range of motion. The range of motion may allow the hand guard to be mounted to a firearm without the need to disassemble the firearm's gas block or gas tube. For example, the top edge of the first clamshell component and the top edge of the second clamshell component may be hingedly connected together, and the bottom edge of the first clamshell component and the bottom edge of the second clamshell component may be unhinged and be both connectable and detachable from each other. This hinged clamshell configuration may allow the hand guard assembly to fit over a firearm's barrel nut and gas tube, and fasten into a closed position while encasing the barrel nut and at least a portion of the gas tube. The disclosed hand guard assembly may also include a locked position, wherein the bottom edge of the first clamshell component and the bottom edge of the second clamshell component may be retained in a fixed position relative to each other and/or relative to the barrel of the firearm. When in this locked position, the two clamshell components may no longer be pivotally rotated with respect to each other. Numerous configurations and variations will be apparent in light of this disclosure.

General Overview

There are a number of non-trivial issues that can arise with hand guard installation. For example, many firearm hand guards require permanent modification of the firearm before the hand guard may be installed. To install a hand guard, the original standard barrel nut must generally be removed and replaced with a proprietary barrel nut configuration. After this modification, only hand guards and mounting rails that are compatible with the proprietary system may interface with the modified firearm. This modification thus limits the possible functionalities of the firearm. Furthermore, once this modification has been made, the firearm cannot be returned to its original standard format. Some hand guard assemblies also require that the gas block and gas tube be removed each time a hand guard is attached or detached. These configurations are also unfavorable because a significant amount of time is required merely to add or to replace a hand guard. Furthermore, these configurations are impractical for use in a combat situation because they are not time-efficient and require tools that are sometimes not readily available.

Embodiments of hand guard assemblies are disclosed to alleviate some or all of these issues. The hand guard's clamshell configuration can allow for easy mounting onto a firearm and removal from a firearm without the need to disassemble the firearm's gas block or gas tube and/or modify the standard barrel nut. In some embodiments, the hand guard may be entirely supported by the standard barrel nut, and may remain in a stable position without employing additional support, such as delta retaining rings or foregrip retainer caps.

For example, the disclosed hinged hand guard assemblies may be mounted on a firearm with either no retrofitting or only minor reversible adjustment to the firearm. In some embodiments, for example, a hand guard assembly may be mounted on a barrel nut. In some embodiments, the hand guard assembly may be attached and detached from a firearm while a gas block and/or gas tube remain in place on the firearm. In further embodiments, the hand guard assembly may be fully supported by the barrel nut. In such an embodiment, the hand guard assembly need not rest on the barrel at all, as it is fully supported by and retained on the barrel nut. This may be favorable because when hand guards or other components rest on the firearm barrel, heat may be transferred via conduction to those components.

Hand guards can serve multiple functions, including, for example, providing a better gripping surface for improved rifle control, protecting a user from heat radiated by the barrel during use and protecting the operational components of the rifle. Hand guards can additionally provide surfaces on which tactile accessories, such as scopes, laser aiming devices, tactical lights, night vision devices, foregrips, bipods, and/or bayonets may be mounted to the firearm. Some firearms may be purchased with factory-issued hand guards. However, a user may choose to replace a factory-issued hand guard with an improved hand guard that provides, for example, better heat dissipation, additional mounting rails, or a preferred aesthetic appearance.

Some embodiments of the hand guard assemblies described herein may provide increased ease of attachment and removal when compared to existing hand guard assemblies. Some embodiments may provide a hand guard assembly that may be attached to and detached from a rifle without disassembling the rifle's gas block or gas tube. Additionally, some embodiments can be used to provide a hand guard assembly that is fully compatible with a standard barrel nut and do not require barrel nut modification or replacement. These features may result in a reduction of the cost of repair, modification and/or replacement of the firearm.

In some instances, a hand guard assembly using the disclosed techniques can be configured, for example, as: (1) a left clamshell component and right clamshell component of the hand guard able to be hingedly connected; and/or (2) a kit or other collection of discrete components (e.g., a left clamshell component and right clamshell component of a hand guard, a barrel nut, tools for configuring the hand guard assembly, a rifle, and/or accessories compatible with the hand guard). The components herein described may be operatively coupled as desired.

For purposes of clarity, a firearm is not always illustrated in relation to the hand guard in all figures provided herein. However, it is to be understood that in all figures in which a barrel nut is shown, the barrel nut may be located in its operative position, namely, at the rear portion of the firearm's barrel.

The present disclosure describes hand guards that may interface with any automatic or semi-automatic rifle, such as an AR-15, an M4 carbine, an AR-10, an M16, or the SIGM400 Series tactical rifle as produced by SIG SAUER. For simplicity, the term "rifle" or "firearm" as used in this disclosure shall be understood to include all described and similar firearms.

The terms "longitudinal," "transverse," "horizontal," and "vertical" are used herein to indicate directions relative to a rifle barrel when held normally, and pointed in a horizontal direction. "Longitudinal" thus means along or parallel to the axis of the rifle's barrel and "transverse" means in a horizontal direction perpendicular to longitudinal.

The terms "rear" and "rearward" as used herein mean in the direction away from the muzzle of the firearm. The terms "front" and "forward" are used to indicate a direction towards the muzzle of the firearm. As used herein, the terms "left" and "right" correspond to the left and right direction of a user while holding the firearm in a normal position.

Structure and Operation

Figure 1B:
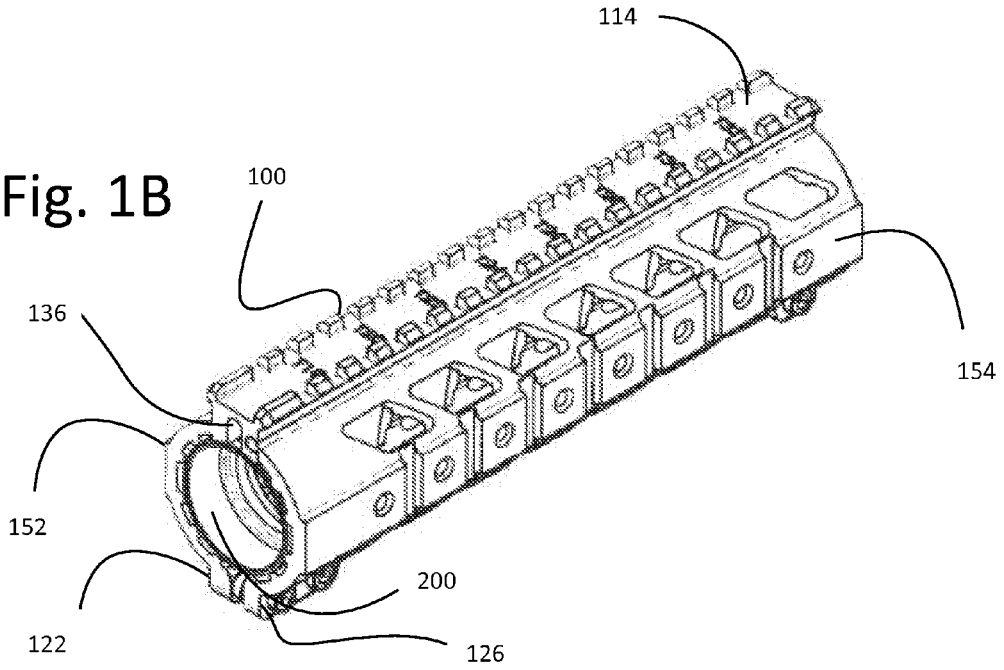
FIG. 1B is a perspective view of a hand guard assembly configured in accordance with the embodiment of FIG. 1A.

FIGS. 1A and 1B are an exploded view and a perspective view, respectively, of a hand guard assembly. Hand guard assembly 100, as shown in FIG. 1A, may comprise a left clamshell component 102 and a right clamshell component 104. Left clamshell component 102 and right clamshell component 104 may be hingedly connected to each other such that left clamshell component 102 may pivot with respect to right clamshell component 104 and/or right clamshell component 104 may pivot with respect to left clamshell component 102. Hand guard assembly 100 may be formed to accommodate barrel nut 200. FIG. 1B shows an embodiment of hand guard assembly 100 positioned on barrel nut 200.

As shown together, right clamshell component 104 and left clamshell component 102 may form a hinge located near the top of hand guard assembly 100. However, the present disclosure is not limited to an embodiment having a left clamshell component 102 and a right clamshell component 104. For example, hand guard assembly 100 may be positioned on barrel nut 200 in a different orientation, whereby either left clamshell component 102 and/or right clamshell component 104 forms a top component and the other of left clamshell component 102 and right clamshell component 104 forms a bottom component. Similarly, hand guard assembly 100 may be placed in any position between these two embodiments. The present disclosure thus does not limit hand guard assembly 100 to a right clamshell component and left clamshell component, but rather, the term "left clamshell component" and "right clamshell component" are used throughout the disclosure for ease of description in reference to the figures provided.

FIG. 1A shows an embodiment wherein left clamshell component 102 includes a tubular receiving channel 106 configured to mate with a monorail 108 of right clamshell component 104. In some embodiments, left clamshell component 102 and right clamshell component 104 of hand guard assembly 100 may completely detach. For example, monorail 108 may be able to slide into and out of tubular receiving channel 106. In other embodiments, left clamshell component 102 and right clamshell component 104 may be fixed together and/or formed to be permanently attached. For example, monorail 108 may be fixed within tubular receiving channel 106.

It should be noted that although tubular receiving channel 106 is shown on left clamshell component 102, the present disclosure also includes embodiments wherein right clamshell component 104 comprises tubular receiving channel 106 and left clamshell component 102 comprises a mating monorail 108.

As shown in FIGS. 1A and 1B, hand guard assembly 100 may be mounted on a standard star-shaped barrel nut 200. In such an embodiment, left clamshell component 102 and right clamshell component 104 may connect at their respective unhinged sides to form a tubular hand guard assembly 100, as is illustrated in FIG. 1B. As shown, hand guard assembly 100 has a substantially cylindrical inner wall. In other embodiments, however, hand guard assembly 100 may have a substantially oval, square, pentagonal, hexagonal, or octagonal-shaped inner wall cross-section.

As described, a hand guard assembly may consist of, or consist essentially of, only two components. Connectors, such as bolts, may also be included. Hand guard assembly 100 may consist of a left clamshell component 102 and a right clamshell component 104. Left clamshell component 102 and right clamshell component 104 may be hinged to each other and form a hand guard assembly consisting of or consisting essentially of two components. For example, left clamshell component 102 may include a tubular receiving channel 106 and right clamshell component 104 may include a monorail 108, wherein monorail 108 and tubular receiving channel 106 are configured to mate. This can eliminate any need for a hinge pin. In some embodiments, left clamshell component 102 and right clamshell component 104 may be detachable and re-attachable. In other embodiments, left clamshell component 102 and right clamshell component 104 may be permanently attached, but remain able to pivot in relation to each other.

Hand guard assembly 100 can be constructed from any suitable material, as will be apparent in light of this disclosure. For instance, in some embodiments, hand guard assembly 100 may be constructed from a rigid material such as metal, aluminum, steel, or polymer composite. In some embodiments, the material used to construct hand guard assembly 100 may be anodized. In some embodiments, hand guard assembly 100 may be constructed from AISI 8620 alloy steel. In other embodiments, hand guard assembly 100 may be constructed from reinforced, heat-resistant polymer, glass, or carbon fiber composite(s). In a more general sense, hand guard assembly 100 can be constructed from any suitable material which is compliant, for example, with United States Defense Standard MIL-W-13855 (Weapons: Small Arms and Aircraft Armament Subsystems, General Specification For). Other suitable configurations and materials for hand guard assembly 100 will depend on a given application and will be apparent in light of this disclosure.

The outer walls of the clamshell components may be curved and/or may include flat surfaces. For example, as shown in FIGS. 1A and 1B, left clamshell component 102 may include left sidewall 152, and right clamshell component 104 may include right sidewall 154. Left sidewall 152 and/or right sidewall 154 may be formed to include flat portions. For example, left sidewall 152 may include a flat portion located at a user's 9 o'clock position. In other embodiments, right sidewall 152 may include a flat portion located at a user's 8 o'clock position and/or 10 o'clock position. In some embodiments, right sidewall 154 may include a flat portion, located at a user's 3 o'clock, 2 o'clock, and/or 4 o'clock position.

Left clamshell component 102 and/or right clamshell component 104 may have apertures 110 extending through left sidewall 152 and/or right sidewall 154, respectively. Apertures 110 can reduce the weight of the hand guard and may be equally spaced, as shown, or unequally spaced. Equally spaced apertures 110 may provide choices of multiple positions at which to attach auxiliary mounting rails. Apertures 110 may optionally be threaded to receive screws or fasteners and secure auxiliary mounting rails and/or accessories to hand guard assembly 100. Apertures 110 may provide other useful functionalities, such as facilitating cooling by allowing air to pass across the barrel and through the hand guard. Apertures 110 also may allow water, dirt, dust and other debris to drain from hand guard assembly 100 when needed.

As can be seen in FIGS. 1A and 1B, the top portion of hand guard assembly 100 may include a mounting rail 114. The term "mounting rail" as used herein shall mean any mounting rail known in the art, including Picatinny, Weaver, and/or STANAG 4694 rails. The pictured embodiment illustrates mounting rail 114 on left clamshell component 102 of hand guard assembly 100. It shall be understood that in other embodiments, right clamshell component 104 may extend to form the top portion of the hand guard, and mounting rail 114 may be positioned on right clamshell component 104, instead of on left clamshell component 102. In another embodiment, hand guard assembly 100 may include additional mounting rails. For example, the bottom portion of hand guard assembly 100, namely where the unhinged ends of left clamshell component 102 and right clamshell component 104 meet, could be manufactured to form a mounting rail positioned where left bottom edge 122 meets right bottom edge 126 at the base of hand guard assembly 100. In another embodiment, hand guard assembly 100 may include a mounting rail positioned on left sidewall 152 and/or right sidewall 154. In some embodiments, auxiliary mounting rails may be positioned at a user's 3 o'clock position, 9 o'clock position, 2 o'clock position, 10 o'clock position, 4 o'clock position, and/or 8 o'clock position.

As shown, left clamshell component 102 and right clamshell component 104 may be approximately equal in length. However, in other embodiments, right clamshell component 104 may be longer or shorter than left clamshell component 102. In some embodiments, left clamshell component 102 and/or right clamshell component 104 may have non-linear front and/or rear edges. Hand guard assembly 100 may be formed to have inside walls with a constant radius of curvature from the rear of hand guard assembly 100 to the front of hand guard assembly 100. Alternatively, hand guard assembly 100 may have an internal radius that increases or decreases from the rear of hand guard assembly 100 to the front of hand guard assembly 100.

Figure 2A:
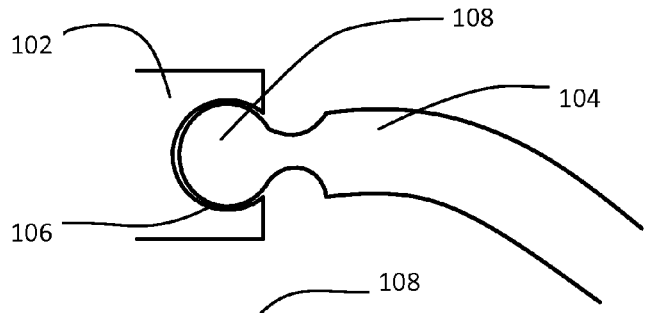
FIGS. 2A, 2B, 2C and 2D are front views of a hinge configured in accordance with an embodiment of a hand guard assembly.
Figure 2B:
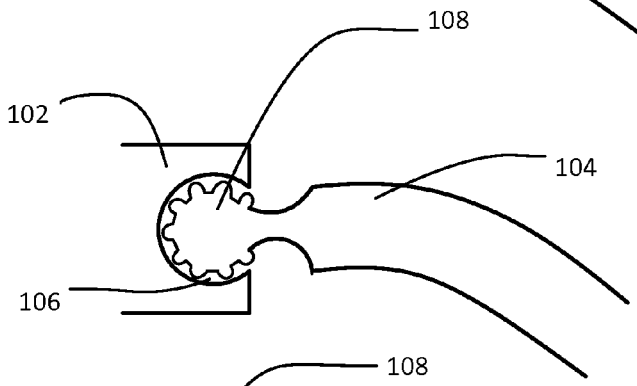
Figure 2C:
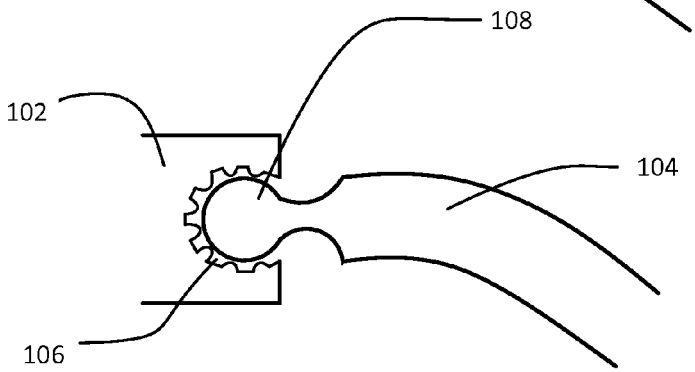
Figure 2D:
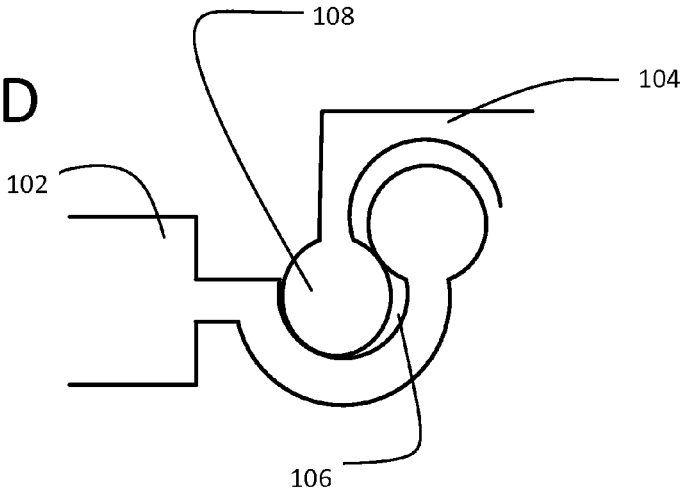

In many embodiments, the intersection of left clamshell component 102 and right clamshell component 104 may form a hinge. Examples of such embodiments are shown in FIGS. 2A-2D, and include embodiments wherein the hinge is formed by the union of monorail 108 on right clamshell component 104 and tubular receiving channel 106 on left clamshell component 102. As shown in FIG. 2A, monorail 108 may have a substantially circular cross-section. In other embodiments, however, monorail 108 may be a knuckle or a pin of a different shape. For example, monorail 108 may include grooves, as shown in FIG. 2B. In some embodiments, tubular receiving channel 106 may have a substantially tubular shape, as shown in FIGS. 2A and 2B. However, in some embodiments, tubular receiving channel 106 may include grooves, as shown in FIG. 2C. Tubular receiving channel 106 may have a radius that is slightly larger than the radius of monorail 108. For example, tubular receiving channel 106 may have a radius that is 1%, 2% or up to 5% larger than the radius of monorail 108. Furthermore, monorail 108 and/or tubular receiving channel 106 can be tapered to ensure fitting and proper alignment.

In some embodiments, however, the hinge may be configured differently. For example, in some embodiments, left clamshell component 102 and right clamshell component 104 may each comprise at least one member, formed to interlock with a member of the opposing clamshell component. An example of such a configuration is provided in FIG. 2D. As can be seen from FIG. 2D, interlocking monorail 108 and tubular receiving channel 106 are formed in different shapes as compared to FIGS. 2A-2C, but still may interlock to form a hinge. In an embodiment shown in FIG. 2D, left clamshell component 102 and right clamshell component 104 may be detached by sliding monorail 108 along a length of tubular receiving channel 106. The embodiment shown in FIG. 2D may allow clamshell components 102 and 104 to pivot with respect to each other.

The present disclosure is also not limited to the hinge design shown in the figures provided herein. In yet another embodiment, left clamshell component 102 and right clamshell component 104 may each comprise at least one tubular section, wherein the tubular section(s) of left clamshell component 102 and tubular section(s) of right clamshell component 104 can be aligned to provide a single, continuous tubular recess. In such an embodiment, left clamshell component 102 and right clamshell component 104 may be hingedly connected by inserting a hinge pin into the tubular recess formed when the tubular sections align. In some embodiments, left clamshell component 102 and right clamshell component 104 may be joined by a continuous hinge, or a piano hinge. Also, in some embodiments, left clamshell component 102 and right clamshell component 104 may interface by way of more than one hinge located on the same longitudinal axis of hand guard assembly 100.

Left clamshell component 102 and right clamshell component 104 may each include complementary mating members of a full-length monorail hinge. In some embodiments, however, left clamshell component 102 and right clamshell component 104 may be joined together with a hinge that extends only a partial distance along the length of hand guard assembly 100.

In some embodiments, the monorail may be integral to the clamshell component to which it is attached. In other embodiments, the monorail may be formed from a material separate from the clamshell component and be subsequently attached to a clamshell component. Similarly, the tubular receiving channel may be integral to a clamshell component, while in other embodiments it is formed separately and subsequently the two pieces may be fixed together.

Figure 3:
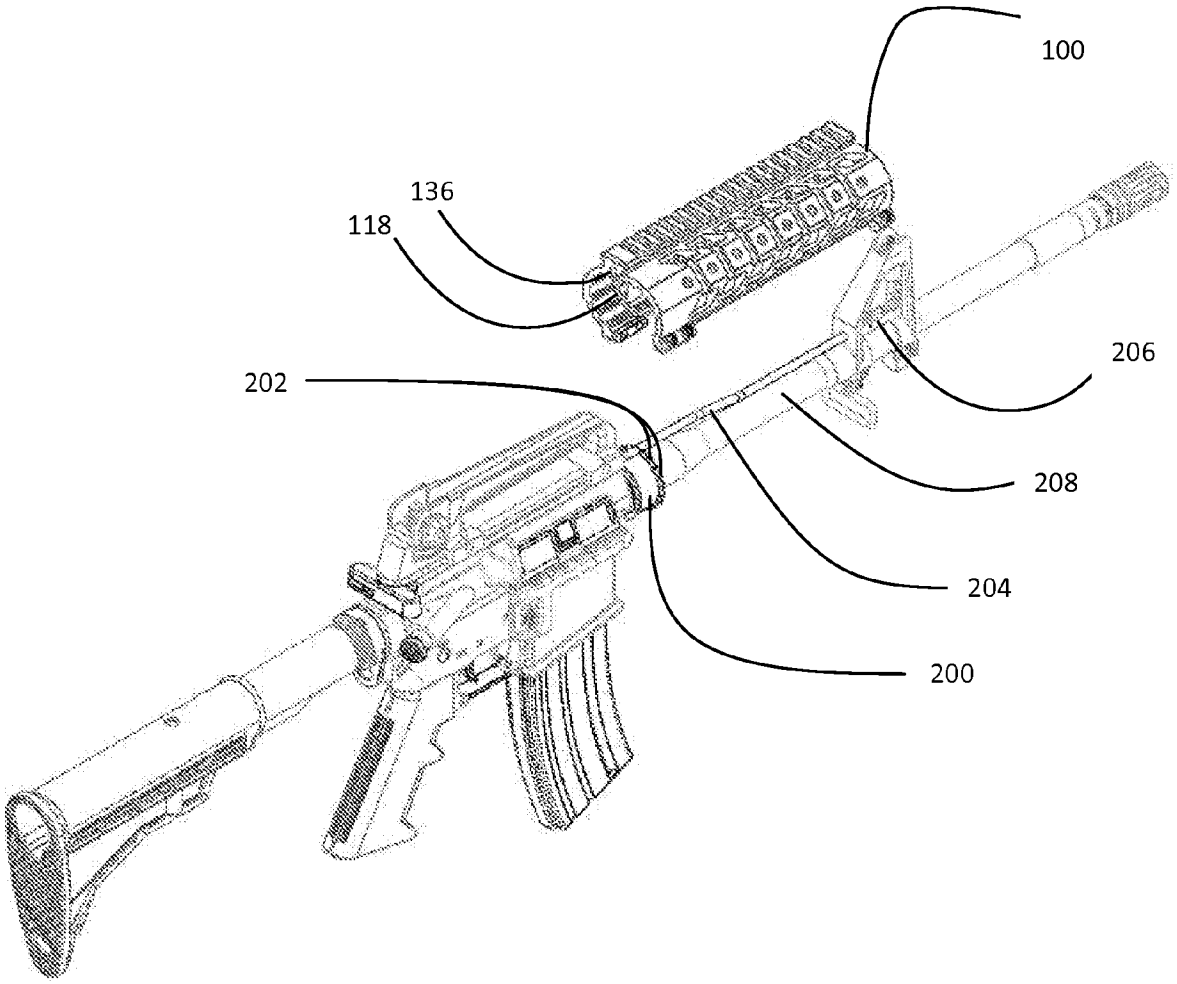
FIG. 3 is a rear right perspective view of a hand guard assembly in an open position and oriented to be mounted on a firearm.

Left clamshell component 102 and right clamshell component 104 may include features that allow hand guard assembly 100 to be retained on barrel nut 200 and maintained in a stationary position when mounted on a firearm. For example, in some embodiments, the inner walls of first clamshell component 102 and second clamshell component 104 may include at least one radial groove 118. In some embodiments, radial groove 118 may extend around a circumference of the inside walls of hand guard assembly 100. As shown in FIG. 3, radial groove 118 may be configured to accommodate sprockets 202 of barrel nut 200. For example, radial groove 118 may have a radius that is substantially equal to (within 1%) the largest radius measured across the barrel nut. Radial groove 118 may retain hand guard assembly 100 on barrel nut 200 and may prevent hand guard assembly 100 from moving in a longitudinal direction when hand guard assembly 100 is mounted on a firearm.

Figure 4:
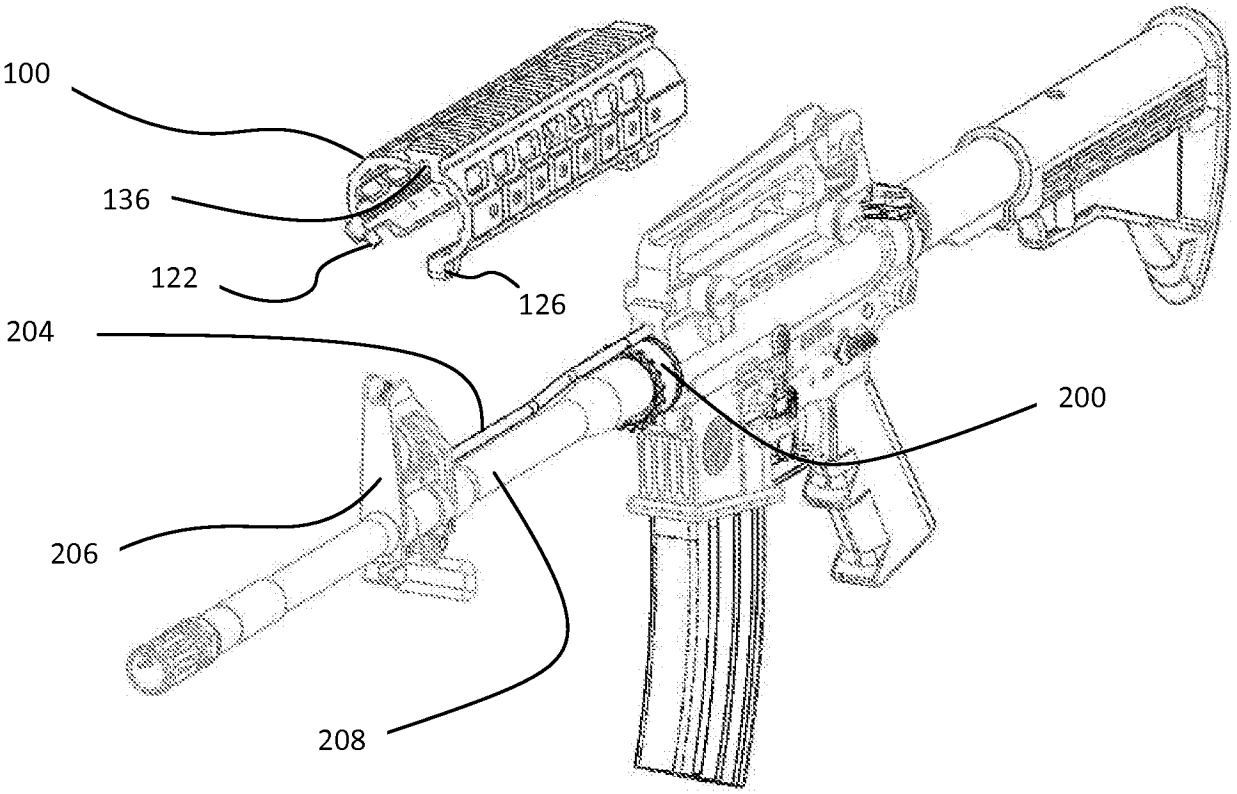
FIG. 4 is a front left perspective view of a hand guard assembly in an open position and oriented to be mounted on a firearm.

As shown in FIG. 4, hand guard assembly 100 may also include notch 136. Notch 136 may extend longitudinally along the entire length of the hand guard assembly 100, and may be shaped to accommodate a firearm's gas tube 204. In some embodiments, notch 136 may be formed to be in contact with gas tube 204 when hand guard assembly 100 is mounted on a firearm. Alternatively, notch 136 may be formed provide additional clearance for gas tube 204 when hand guard assembly 100 is mounted on a firearm. Notch 136 may prevent hand guard assembly 100 from rotating while mounted on a firearm. In some embodiments, notch 136 may be shaped to allow hand guard assembly 100 to fit over gas tube 204 when hand guard assembly 100 is mounted on barrel nut 200.

In some embodiments, notch 136 may be formed on an inner wall of first clamshell component 102 or on an inner wall of second clamshell component 104. In some embodiments, notch 136 may extend into the inner wall the same distance at a front portion of hand guard assembly 100 as at the rear portion of hand guard assembly 100. In other embodiments, notch 136 may extend into the inner wall to a greater or lesser extent at a rear portion of hand guard assembly 100 than at a front portion of hand guard assembly 100. For example, in FIG. 4, gas tube 204 is not linear. In some embodiments, hand guard assembly 100 could be formed to include notch 136 that is deeper at a rear end of hand guard assembly 100 than at a front end of hand guard assembly 100. In further embodiments, notch 136 may only extend along a portion of the length of hand guard assembly 100. For example, notch 136 may only be formed along a rear portion of hand guard assembly 100 and the hand guard may clear the gas tube at a forward portion without the aid of a notch.

Hand guard assembly 100 may be configured to fit snugly between the firearm's upper receiver 210 and gas block 206, as is illustrated in FIG. 4. In some embodiments, however, hand guard assembly 100 may not extend the entire length between upper receiver 210 and gas block 206. For example, hand guard assembly 100 may be formed to provide greater than 0.01 inches, 0.01-0.05 inches, or 0.01-0.1 inches of clearance between gas block 206 and hand guard assembly 100 and/or upper receiver 210 and hand guard assembly 100.

Figure 5A:
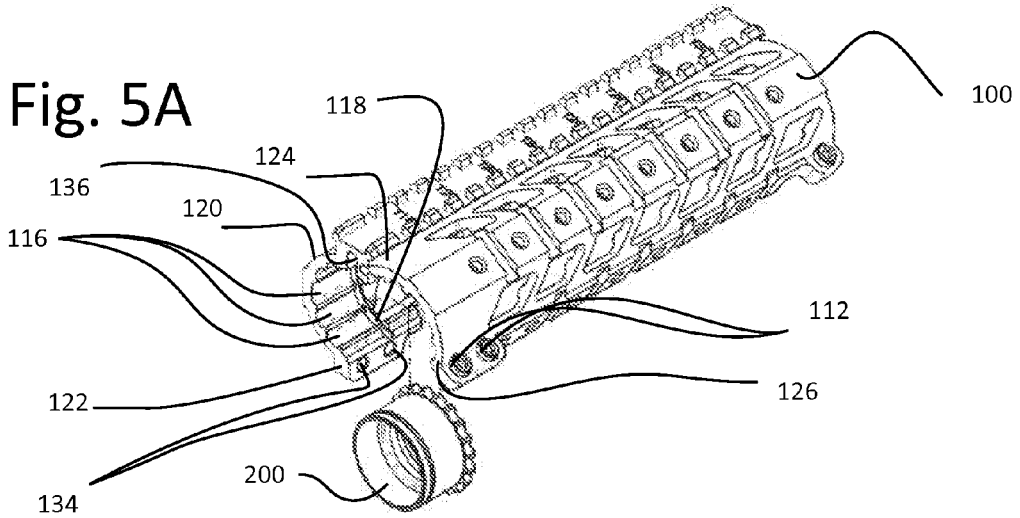
FIGS. 5A, 5B and 5C illustrate a hand guard assembly at various positions in relation to a barrel nut.

As shown in FIG. 5A, right clamshell component 104 and/or left clamshell component 102 may have an internal surface comprising longitudinal grooves 116. In some embodiments, only the inner surface of one of the clamshell components may include grooves 116. In other embodiments, the inner surface of both right clamshell component 104 and left clamshell component 102 include grooves 116. In some embodiments, grooves 116 may extend along the entire inner surface of hand guard assembly 100. In other embodiments, grooves 116 may extend only a partial distance along the length of the inner surface of hand guard assembly 100. In some embodiments, the inner surface of right clamshell component 104 and/or left clamshell component 102 is corrugated, and grooves 116 are defined by the corrugated surface (s). Grooves 116 may serve to decrease the carrying weight of the firearm and may also reduce the manufacturing cost of hand guard assembly 100.

Hand guard assembly 100 may be capable of a range of motion between an open and closed position. The possible range of motion may be sufficient to allow hand guard assembly to be placed over barrel nut 200. For example, first clamshell component 102 may pivot independently up to 180 degrees, and second clamshell component 104 may pivot independently up to 180 degrees. In other embodiments, opposed clamshell components may be able to travel from 0 degrees to 90 degrees. In further embodiments, opposed clamshell components may be able to travel from 0 degrees to 120 degrees. In some embodiments, the clamshells pivot enough so that the distance between opposing edges 122 and 126 provides adequate clearance for the hand guard to pass over barrel nut 200. In other embodiments, gas block 206 and/or gas tube 204 need not be removed before hand guard assembly 100 is mounted on a firearm or when hand guard assembly 100 is removed from the firearm.

Figure 5B:
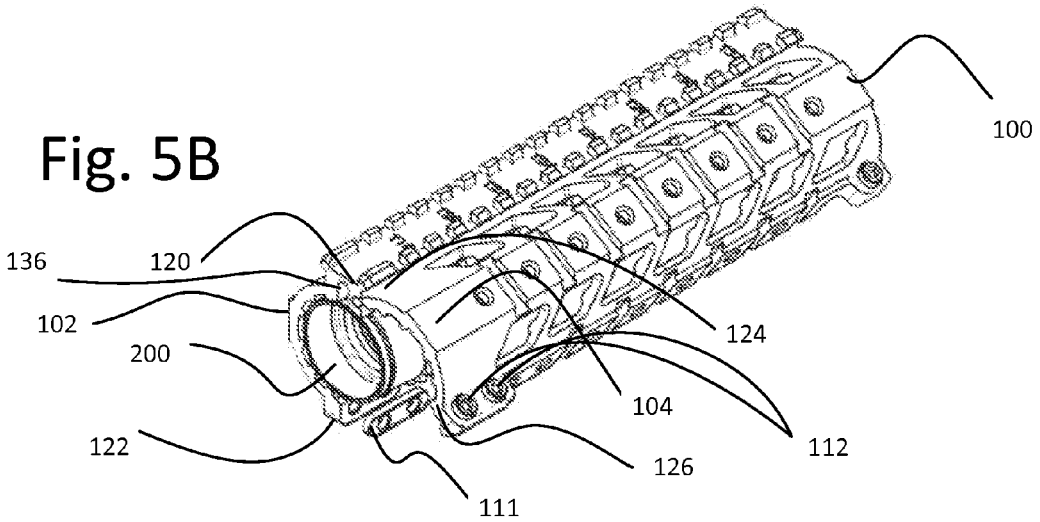
Figure 5C:
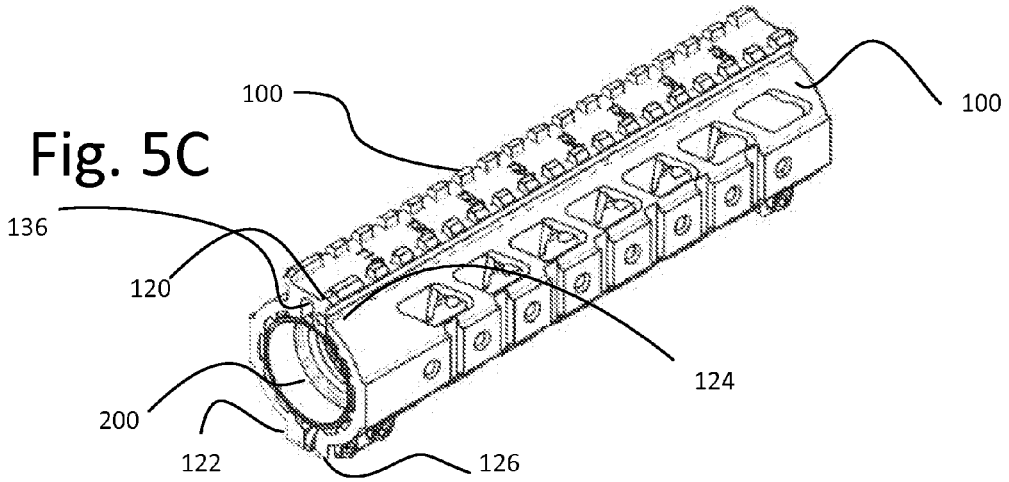

FIGS. 5A, 5B and 5C illustrate hand guard assembly 100 at various stages of assembly. FIGS. 5A-5C also show a possible range of motion of hand guard assembly 100 and relative positions of hand guard assembly 100 to barrel nut 200. FIG. 5A illustrates hand guard assembly 100 in a hinged, open configuration, positioned to surround barrel nut 200 from above. FIG. 5B shows hand guard assembly 100 partially mounted on barrel nut 200, in an open position. FIG. 5C shows hand guard assembly 100 fully mounted on barrel nut 200 in a closed position. In a closed and mounted position, hand guard assembly 100 may encircle the barrel of the firearm and be retained on barrel nut 200. For example, hand guard assembly 100 may accommodate sprockets 202 of barrel nut 200 in radial groove 118. In some embodiments, notch 136 may be placed over gas tube 204, which may also prevent rotation of hand guard assembly 100 about the barrel of the firearm. In some embodiments, both radial groove 118 and notch 136 may retain hand guard assembly 100 firmly in position on a firearm. Hand guard assembly 100 may be fully supported on barrel nut 200, and need not rest on barrel 208. Hand guard assembly 100 may also be capable of locking in a closed position when mounted on barrel nut 200.

In some embodiments, delta retainer rings may be removed before the hand guard is mounted. In some embodiments, the gas block and/or gas tube need not be removed before the hand guard is mounted on or removed from the rifle. Thus, and in accordance with embodiments of the present disclosure, hand guard assembly 100 can be operatively coupled, for example, with barrel nut 200 without interfering with the rifle's gas block, gas tube or altering barrel nut 200.

As can be seen from FIGS. 5A-5C, hand guard assembly 100 may open and close in a clam-shell fashion. As is shown, right clamshell component 104 and left clamshell component 102 may pivot about a common axis that is longitudinal to the barrel (not shown). In some embodiments, left clamshell component 102 may have a hinged edge, herein referred to as left top edge 120 and an unhinged edge, herein referred to as left bottom edge 122. Similarly, right clamshell component 104 may have a hinged edge, herein referred to as right top edge 124 and an unhinged edge, herein referred to a right bottom edge 126. In some embodiments, left top edge 120 may be pivotally connected to right top edge 124 and left bottom edge 122 may be detachable from right bottom edge 126.

In some embodiments, hand guard assembly 100 may have open and closed positions, a closed position being defined by left bottom edge 122 and right bottom edge 126 being compressed against each other, possibly with intervening washers, gaskets, and/or other connecters 111. In some embodiments, an open position of hand guard assembly 100 may be defined by left bottom edge 122 being farther away from right bottom edge 126 than in a closed position. FIG. 5C shows hand guard assembly 100 in a closed position, whereby left bottom edge 122 is compressed against right bottom edge 126. Hand guard assembly 100 may be formed to have left bottom edge 122 meet with right bottom edge 126 when hand guard assembly 100 is in a closed position. Alternatively, unhinged left edge 122 and right bottom edge 126 may not be in contact when hand guard assembly 100 is in a closed position, but may be in compression across connectors 111, such as washers or gaskets.

Hand guard assembly 100 may be equipped with a fastening mechanism to secure hand guard assembly 100 onto barrel nut 200 in a closed and/or locked position. For example, as is shown in FIGS. 5A-5C, hand guard assembly 100 may be configured to receive fasteners 112 through a portion of both right clamshell component 104 and left clamshell component 102. Such fasteners 112 may include screws, nuts, bolts, or other fasteners known in the art. Optionally, additional spacers, such as a gasket or washer may be placed between left clamshell component 102 and right clamshell component 104 to facilitate locking and reduce vibration. In other embodiments, fasteners 112 may pass through a portion of either left clamshell component 102 and/or right clamshell component 104 and secure directly into the firearm. For example, threaded holes 134 may be formed in one component to directly receive bolts or screws. In some embodiments, tools are not necessary to secure the hand guard. For example, the fastener may be a wing bolt or a cam bolt, such as those used to secure quick release bicycle wheels, and can be threaded into a threaded receiving hole manually and tightened manually by operating the cam.

Figure 6:
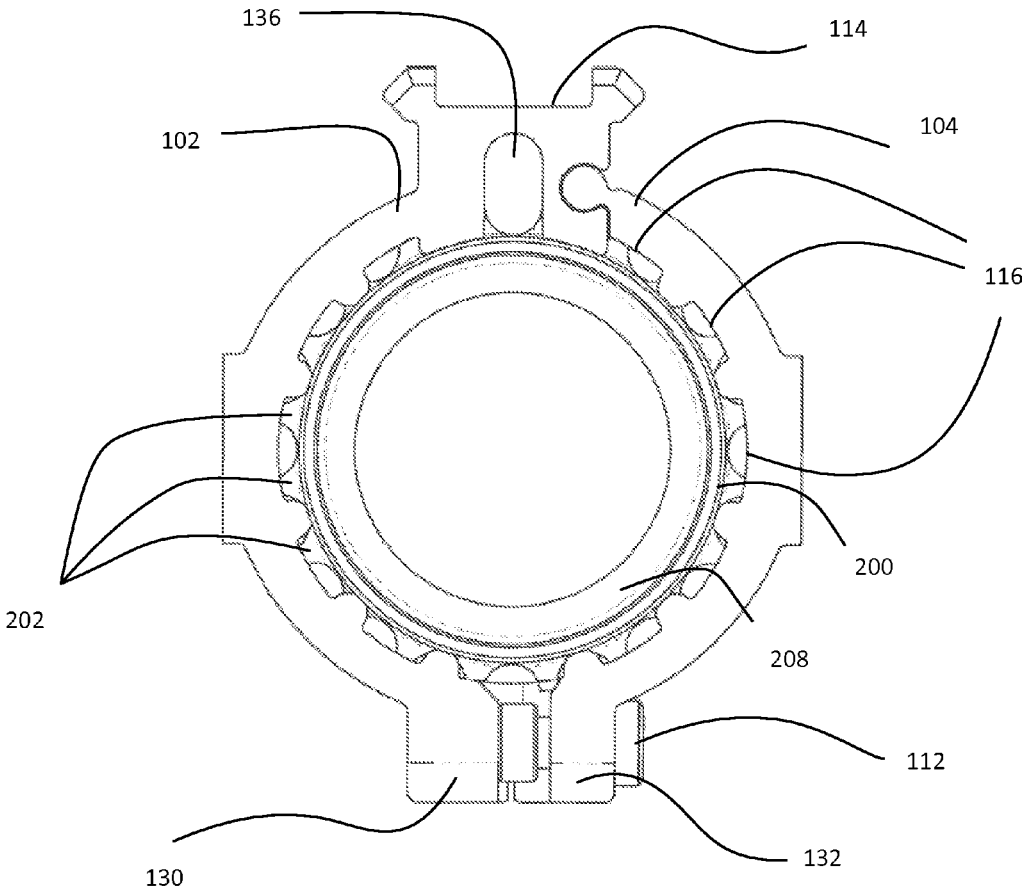
FIG. 6 is a rear view of a hand guard assembly mounted on a barrel nut.

FIG. 6 shows a rear view of hand guard assembly 100 mounted in a closed position on barrel nut 200. It can be seen from FIG. 6 that when hand guard assembly 100 is in a closed and locked position on barrel nut 200, radial groove 118 may accommodate sprockets 202 of barrel nut 200 to retain hand guard assembly 100 on a firearm.

Figure 7:
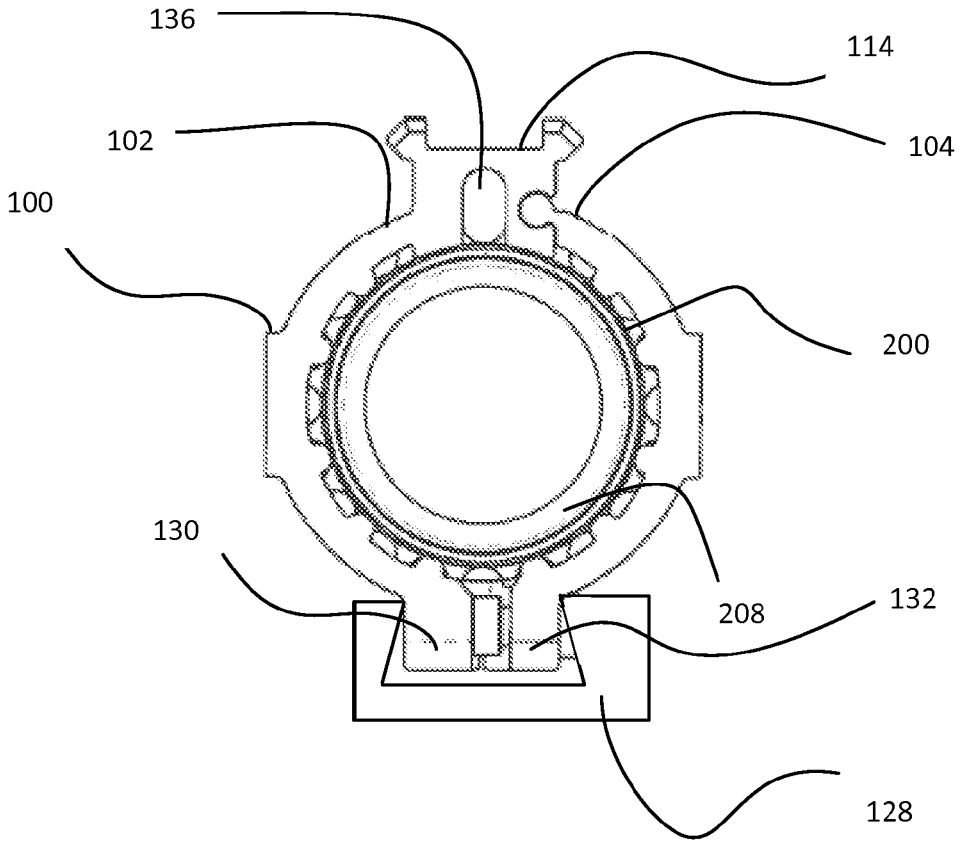
FIG. 7 is a rear view of a hand guard assembly with an attachable closure mechanism mounted on a barrel nut.

FIG. 7 shows an embodiment of a hand guard assembly locked with a separable fastener or clip. For example, as shown in FIG. 7, hand guard assembly 100 may be formed to include bottom tabs, such as left bottom tab 130 and right bottom tab 132. Clip 128 may be formed to snap over left bottom tab 130 and right bottom tab 132 and retain the bottom tabs. The tabs and clip may run the entire length of the hand guard. A separable fastener, as illustrated in FIG. 7 may thus lock hand guard assembly 100 in a closed position on a firearm.

In another embodiment of the present disclosure, a kit is provided, wherein an unassembled hand guard assembly 100 is contained. For example, the kit may comprise a right clamshell component 104 and a left clamshell component 102, according to an embodiment described above in detail, wherein the right clamshell component 104 and the left clamshell component 102 are detached. In another example, a connected hand guard assembly according to an embodiment described herein may be included in the kit. In one embodiment, an assembled or unassembled hand guard is provided, along with any fasteners needed to mount hand guard assembly 100 on a firearm, including bolts, nuts, and/or washers. In another embodiment, an assembled or unassembled hand guard is included in a kit with a firearm and may be either mounted or unmounted. In some embodiments, mounting accessories are included in the kit. In some further embodiments, any tools necessary and/or fasteners required to mount hand guard assembly 100 to the firearm are also included in the kit.

Figure 8:
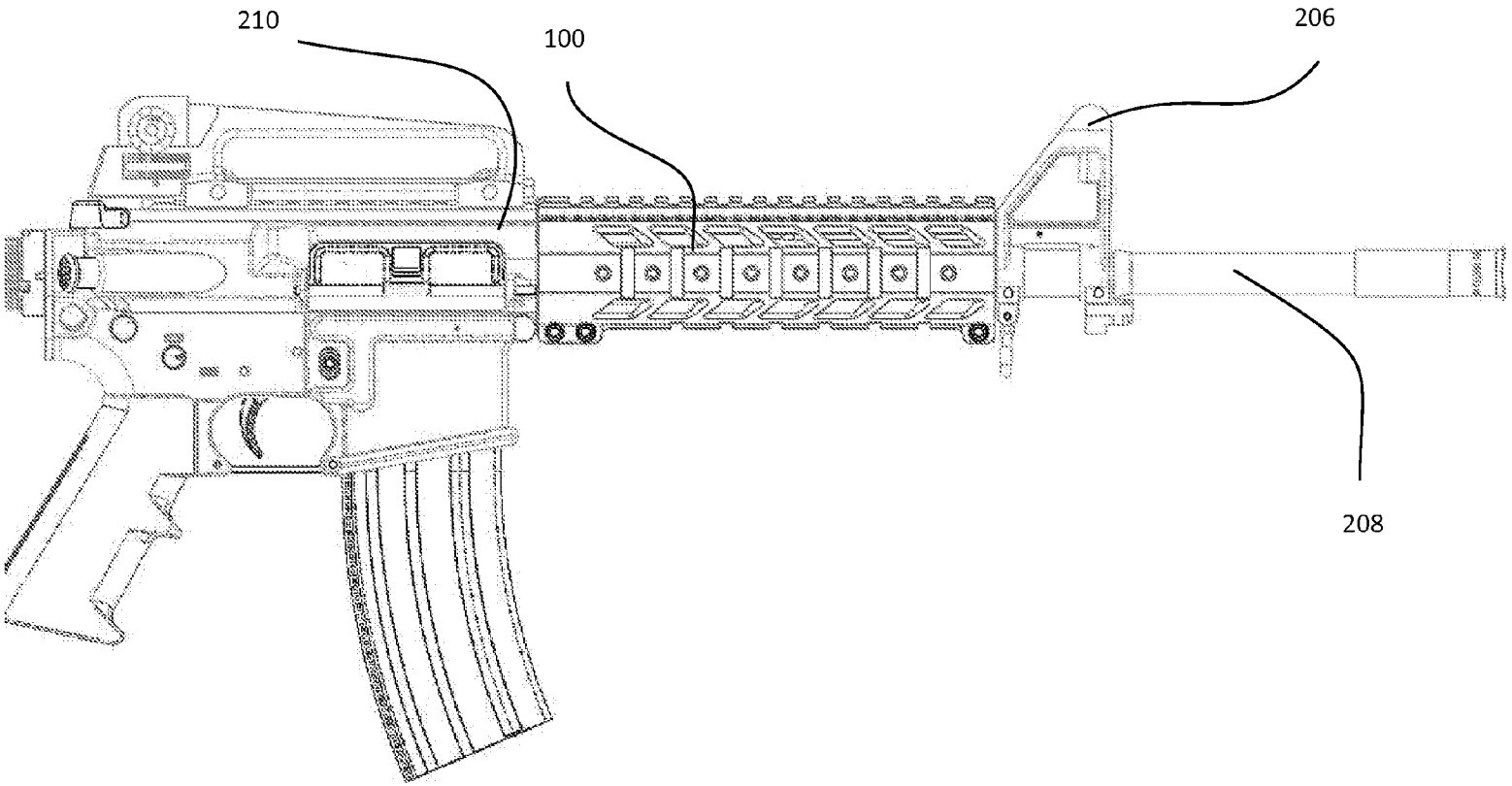
FIG. 8 is a right side view of a hand guard assembly mounted on a firearm.

The present disclosure also provides a method of utilizing a hand guard made in accordance with this disclosure. In some embodiments, delta retaining rings may be removed from the firearm before a hand guard according to an embodiment described herein may be attached to the firearm. An illustration of a hand guard assembly mounted on a firearm is provided in FIG. 8. As can be seen from FIG. 8, the delta retaining rings may not be required to retain hand guard assembly 100 on the firearm. In FIG. 8, gas tube 204 is not visible as it is covered by hand guard assembly 100.

Figure 9:
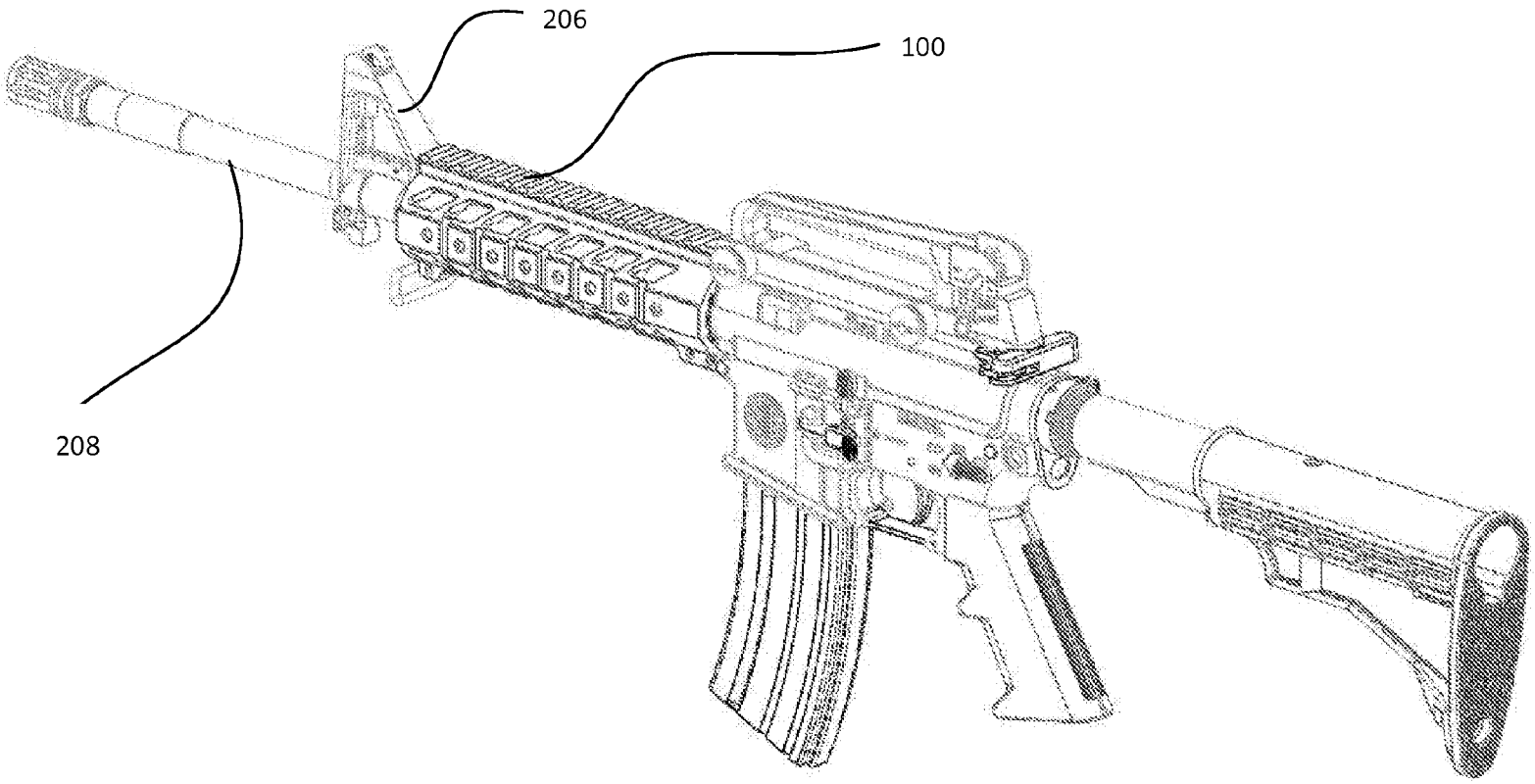
FIG. 9 is a rear left perspective view of a hand guard assembly mounted on a firearm.
Figure 10:
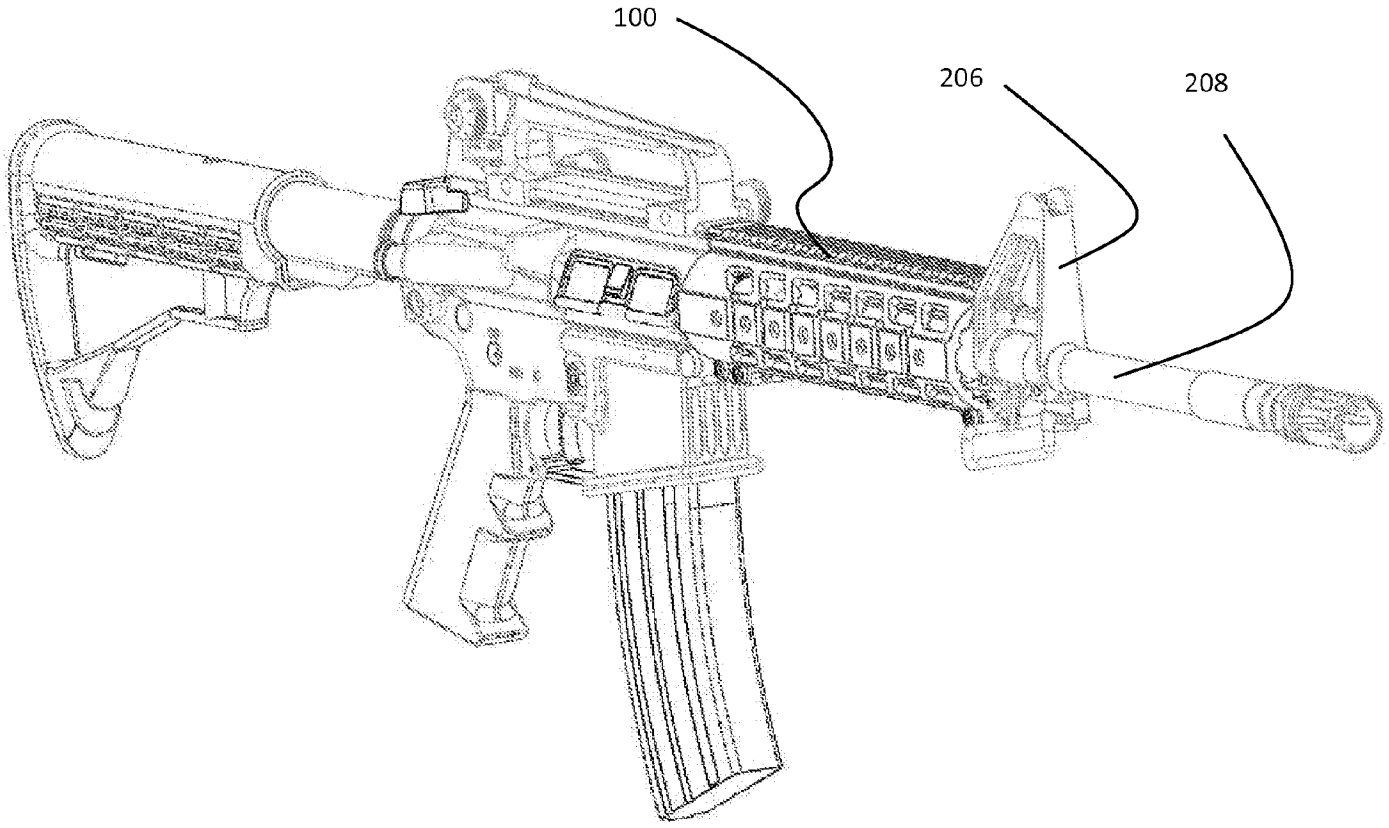
FIG. 10 is a front right perspective view of a hand guard assembly mounted on a firearm.

FIGS. 9 and 10 illustrate a hand guard assembly mounted on a firearm. FIG. 9 provides a rear left perspective view, and FIG. 10 provides a front right perspective view. As can be seen from these figures, hand guard assembly 100 can be mounted on a firearm in a convenient position for firing or carrying and can provide additional surfaces on which accessories may be mounted. As shown, hand guard assembly 100 may cover barrel 208 and gas tube 204 when hand guard assembly 100 is in a mounted and closed position.

In an example method, a factory-mounted hand guard is removed from a firearm. Removal may require a user to detach the firearm's gas block and/or gas tube. The user then may re-attach the gas block and/or gas tube to the firearm. The user may attach a hand guard assembly 100 configured in accordance with this disclosure to the firearm without needing to alter gas block 206 or gas tube 204 in any way. For example, a user may orient hand guard assembly 100 in an open position, over barrel 208, place notch 136 over gas tube 204, and radial groove 118 over sprockets 202 of barrel nut 200. A user may then place hand guard assembly 100 in a closed position, wherein hand guard assembly 100 encircles barrel 208. The user need not alter the barrel nut in any way to mount the hand guard on the firearm. Finally, a user may lock hand guard assembly 100 on the firearm. The user may optionally detach hand guard assembly 100 from the firearm without removing the gas block or gas tube or altering the barrel nut.

In another example, a user obtains a firearm without a hand guard attached. The user removes the delta retaining rings (if present) and the foregrip retainer caps (if present). In one embodiment, the user does not modify the barrel nut or remove the gas block or gas tube. The user then attaches a hand guard made in accordance with this disclosure to the firearm by positioning the hand guard assembly over the gas tube and placing the radial groove over the sprockets of the barrel nut. The hand guard may be fully supported by the barrel nut when the hand guard assembly is in a closed position. The user may lock the hand guard assembly in place on the firearm. The user then may then detach the hand guard from the firearm without removing the gas block or modifying the barrel nut.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A hand guard for a firearm, the hand guard comprising:
- a first clamshell component comprising:
  - a top longitudinal edge defining a receiving channel;
  - a bottom longitudinal edge;
  - an inner surface; and
  - an outer surface;
- a second clamshell component comprising:
  - a top longitudinal edge defining a monorail formed to mate with the receiving channel;
  - a bottom longitudinal edge;
  - an outer surface; and
  - an inner surface; and
- a fastener for securing the bottom longitudinal edge of the first clamshell component to the bottom longitudinal edge of the second clamshell component.

2. The hand guard of claim 1, further comprising a radial groove on the inner surfaces of both the first clamshell component and the second clamshell component.

3. The hand guard of claim 2, wherein a radius of the radial groove is approximately equal to a radius of a barrel nut.

4. The hand guard of claim 2, wherein the inner surface of one of either the first clamshell component or the second clamshell component comprises a longitudinal notch.

5. The hand guard of claim 1, further comprising a longitudinal notch formed on the inner surface of at least one of either the first clamshell component or the second clamshell component.

6. The hand guard of claim 1, wherein the first clamshell component is completely detachable from the second clamshell component.

7. The hand guard of claim 1, wherein the hand guard does not include a hinge pin separate from the clamshell components.

8. The hand guard of claim 1, wherein the hand guard is compatible with an M16-style firearm.

9. The hand guard of claim 1, wherein the hand guard is compatible with an AR15-style firearm.

10. The hand guard of claim 1, wherein at least one of the first clamshell component and the second clamshell component comprises at least one aperture extending from the inner surface to the outer surface.

11. The hand guard of claim 1, wherein the first clamshell component and the second clamshell component are each semi-tubular, and the hand guard has a substantially circular cross-section when in a closed position.

12. The hand guard of claim 1, wherein the fastener is threaded.

13. The hand guard of claim 1, wherein the fastener is comprised of a first element and a second element, the first element being both interlockable with the second element and detachable from the second element, wherein the second element is integral to the bottom longitudinal edge of the second clamshell component.

14. The hand guard of claim 1, wherein the receiving channel extends from a front end of the first clamshell component to a rear end of the first clamshell component and the monorail extends from a front end of the second clamshell component to a rear end of the second clamshell component.

15. A firearm assembly comprising:
- a firearm comprising:
  - a barrel;
  - a gas tube; and
  - a barrel nut fastened to the barrel, the barrel nut having sprockets extending radially from the barrel nut;
- a hand guard attachable to the firearm and detachable from the firearm, the hand guard comprising:
  - a first side comprising:
    - an inner surface defining a radial groove; and
    - an outer surface defining a recess, the recess extending longitudinally from a front portion of the hand guard to a rear portion of the hand guard;
  - a second side comprising:
    - an inner surface defining a radial groove aligned with the radial groove of the first side; and
    - an outer surface defining an integral hinge pin, the hinge pin extending longitudinally from a front portion of the hand guard to a rear portion of the hand guard, the hinge pin sized to fit inside the recess, such that the first side of the hand guard can be pivotally connected to the second side of the hand guard; and
- a fastener configured to connect the first side of the hand guard and the second side of the hand guard, the fastener able to lock the second side of the hand guard and the first side of the hand guard together such that the hand guard encircles at least a portion of the barrel when the hand guard is secured on the barrel nut, and wherein the only point of contact between the barrel and the hand guard is at the barrel nut.

16. The firearm assembly of claim 15, further comprising a mounting rail formed on at least one of the outer surface of the first side and the second side.

17. The firearm assembly of claim 15, wherein at least one of either the inner surface of the first side or the inner surface of the second side comprises a longitudinal notch formed to accommodate the gas tube.

18. A firearm comprising:

a barrel having a longitudinal axis, a right side and a left side;

a barrel nut aligned with the longitudinal axis of the barrel; and a hand guard comprising:

a first hand guard component; and a second hand guard component pivotally connected to the first hand guard component about an axis parallel to the longitudinal axis of the barrel, such that in a mounted state the second hand guard component is substantially disposed on the right side of the barrel and the first component and the second component, together, encircle at least a portion of the barrel, and an inner surface of the hand guard is in contact with the barrel nut when in a mounted state.

19. The firearm of claim 18, wherein the first hand guard component includes a radial groove on an inner surface and the radial groove is formed to accommodate the barrel nut.

20. The firearm of claim 18, further comprising a gas tube, wherein at least one of the first hand guard component and the second hand guard component comprises a longitudinal notch located on an inner surface and the longitudinal notch is formed to accommodate the gas tube.

* * * * *